US005188755A

United States Patent [19]

Chang

[11] Patent Number: 5,188,755

[45] Date of Patent: Feb. 23, 1993

[54] SURFACE ERODIBLE CONTROLLED RELEASING, FREE STANDING CLEANSING BLOCK AND CLEANING METHOD FOR THE DOMESTIC WATER CLOSET

[75] Inventor: Tiang-Shing Chang, Westfield, N.J.

[73] Assignee: Block Drug Company, Jersey City, N.J.

[21] Appl. No.: 774,477

[22] Filed: Oct. 10, 1991

[51] Int. Cl.[5] ..... C11D 17/00; C11D 3/48; C11D 1/66

[52] U.S. Cl. ..... 252/174; 252/90; 252/174.17; 252/174.22; 252/175; 252/DIG. 11; 252/DIG. 16; 252/106; 4/222; 4/227.1; 4/227.5; 134/42; 210/698

[58] Field of Search ..... 252/90, 106, 174, 174.17, 252/174.22, 175, DIG. 11, DIG. 16; 210/698; 134/42; 4/222, 227.1, 227.5

[56] References Cited

U.S. PATENT DOCUMENTS

| | | | |
|---|---|---|---|
| 4,043,931 | 8/1977 | Jeffrey et al. | 252/90 |
| 4,234,442 | 11/1980 | Cornelissens | 252/174 |
| 4,269,723 | 5/1981 | Barford et al. | 252/174.11 |
| 4,722,802 | 2/1988 | Hutchings et al. | 252/174 |
| 4,908,148 | 3/1990 | Caravajal et al. | 252/174 |
| 4,911,858 | 3/1990 | Bunczk et al. | 252/174 |

*Primary Examiner*—A. Lionel Clingman
*Assistant Examiner*—Bradley A. Swope
*Attorney, Agent, or Firm*—Ostrolenk, Faber, Gerb & Soffen

[57] ABSTRACT

A surface erodible controlled releasing, free standing cleaning block for domestic water closets comprises controlled releasing agent, erosion rate modifier, processing aid, acidic chelating agent, color indicator, density modifier and internal lubricant.

17 Claims, No Drawings

SURFACE ERODIBLE CONTROLLED RELEASING, FREE STANDING CLEANSING BLOCK AND CLEANING METHOD FOR THE DOMESTIC WATER CLOSET

BACKGROUND OF THE INVENTION

Cleansing compositions which are immersed in the flush water cistern of a lavatory bowl or urinal and are slowly dissolved to release an active ingredient which serves to assist in cleansing the lavatory bowl or urinal when water is flushed from the cistern into the lavatory bowl or urinal are well known. Such products are generally of two types, the dispenser type and the drop-in type. The dispenser type employs a container or a two-component metering device containing two incompatible cleansing compositions but is an inconvenient and messy component of the product which must be removed from the tank and disposed of when the chemicals are exhausted. The drop-in type product eliminates this problem but reintroduces all of the problems which the dispenser was designed to circumvent.

It has long been known that both iron and manganese cause serious staining problems in potable and industrial water systems. The most common form in which these elements are found in the water systems are as soluble ferrous carbonate and manganeous bicarbonate. Household water generally contains about 0.05 mg/l of manganese and of about 0.3 mg/l of iron, usually in the form of soluble salts. When the concentration of oxidizing agents in the household water, such as residual chlorine, is higher than 0.5 mg/l, the manganese and iron are slowly oxidized, especially at pHs above 7, on the porcelain surfaces and form water insoluble manganic or ferric compounds, respectively. These precipitates adhere to the porcelain surface and eventually form a dark brown stain, especially the water-porcelain-air interface where water evaporation takes place resulting in what is commonly called "toilet bowl ring". The ring may also contain other mineral deposits such as calcium and magnesium carbonates and sulphates and organic matter.

There have been previous attempts to inhibit the formation of the mineral stain on the porcelain surface of the water closets and some of these are described in U.S. Pat. Nos. 4.283,300, 4,302,350, 4,428,872 and 4,452,713. These patents describe the use of water soluble polymers or copolymers, such as partially hydrolyzed polyacrylamides, salts of polyacrylic acid, copolymers of ethylene and maleic anhydride and copolymers of methyl vinyl ether and maleic anhydride. These polymers and copolymers contain multiple carboxylate or carboxylic acid moieties which provide them with the properties of a chelating agent, permitting the polymers to sequester metal ions such as iron and manganese. The patents describe a method for cleaning the domestic water closet by dispensing the polymeric chelating agent and an oxidizing agent separately in a two-compartment system which is capable of dispensing the ingredients into the water closet concurrently and independently. However, as previously noted, the two-compartment dispenser system is very difficult to practice in addition to being costly.

Another approach is to make surfactant cleansing blocks by tabulating, casting or extrusion. This is described for instance in U.S. Pat. Nos. 4,043,931, 4,269,723, 4,460,490, 4,438,015, 4,722,802, 4,738,728 and 4,082,449. The surfactant in these cleansing blocks is released gradually over an extended period of time to clean the porcelain surface of the water closets. None of these, however, attempt to inhibit the initial formation of the mineral stain on the porcelain surface.

It is accordingly the object of this invention to provide a cleansing block, for use either as a drop-in type or a dispenser type employed in a container, which operates to inhibit the formation of a mineral stain on the porcelain surfaces of a water closet. This and other objects of the invention will become apparent to those of ordinary skill in this art from the following detailed description.

SUMMARY OF THE INVENTION

This invention relates to a cleansing block and its use to inhibit the formation of mineral stains on the porcelain surfaces of a domestic water closet. More particularly, the invention relates to an improved cleansing method and composition in the form of a surface erodible, controlled release block which contains hydroxypropyl cellulose and/or polyethylene oxide as a controlled releasing agent, polyalkoxylated cetyl or stearyl alcohol as an erosion rate modifier, polyoxypropylene-polyoxyethylene block copolymer as a processing aid, fumaric, L-aspartic and/or citric acid as a chelating and pH controlling agent, isobornyl acetate and/or silicon oil as an internal lubricant and a density modifier to provide the block with a density of about 1.2 to 1.8 g/ml. The block preferably contains a suitable color indicator and can contain other materials such perfumes, germicides, preservatives, surfactants and fillers. When immersed in a water closet, the block releases its active ingredients uniformly and continuously to the water so as to provide an acidic environment as well as a sufficient amount of chelating agent to inhibit the formation of mineral stains on the porcelain surfaces for an extended period of time of about 1 to 5 months. The block continuously provides a mild acidic environment, of pH between about 4.5 and 7, to give a sparkling appearance to the water.

DESCRIPTION OF THE INVENTION

In accordance with the present invention, an improved cleaning method and composition in the form of a surface erodible, controlled releasing block for domestic water closets is provided. As a result of its particular formulation, the block provides a uniform and continuous release of active ingredients to the water to provide an acidic environment which provides the water with a sparkling appearance as well as a sufficient amount of chelating agent to inhibit the formation of mineral stains on the porcelain surfaces of the domestic water closet for an extended period of time of about 1 to 5 months and preferably about 2 to 4 months. The block contains particular controlled releasing agents, erosion rate modifiers, processing aids, chelating and pH controlling agents, internal lubricant and density modifier and optionally a color indicator and other ingredients. The block usually has a weight of from about 40 to 125 grams although other size blocks can be made if so desired. The block has a density from about 1.2 to 1.8 g/cc, preferably about 1.25 to 1.65 g/cc, and when dissolved in water at a concentration of 10 ppm provides a mildly acidic medium with a pH between about 4.0 and 7, preferably about 4.3 to 6.7.

The surface erodible, controlled releasing matrix must be compatible with an acidic medium and for this purpose contains at least a controlled releasing agent, erosion modifier, processing aid and internal lubricant constituting about 7.5 to 85% by weight of the block and preferably from about 15 to 60%.

The controlled releasing agent is either hydroxypropyl cellulose or polyethylene oxide or a mixture thereof and is present in the block from about 2 to 35% by weight, preferably about 4 to 25% by weight and most preferably about 5 to 22% by weight. Both of these agents are non-ionic, water soluble, acid stable polymers and have the capacity of acting as dispersants to retard soil deposition. Preferably the hydroxypropyl cellulose has a molecular weight from about 500,000 to 1,500,000 and a degree of hydroxypropyl substitution from about 3 to 4.5. The preferred polyethylene oxide has a molecular weight from about 2 million to 6 million.

The erosion rate modifier used in this invention is a water dispersible, acid stable polyalkoxylated cetyl alcohol or stearyl alcohol, or a mixture thereof, containing from about 2 to 8 alkyleneoxy units per molecule, preferably about 4 to 6 units, and having a molecular weight of about 360 to 650. The alkyleneoxy units are preferably ethyleneoxy. It has been observed that these polyalkoxylated cetyl and stearyl alcohols are highly sticky and can function as a binder to provide the other ingredients with a hydrophobic coating and thereby modifying the rate of diffusion of the water to penetrate the controlled releasing block, the rate of hydration of the controlled releasing agent and the rate of erosion of the block. The rate of erosion can be adjusted by incorporating larger or smaller amounts of the erosion rate modifier to provide lesser and greater rates of erosion, respectively. The erosion rate modifier is present in a concentration from about 1 to 25% by weight of the block, preferably from about 2 to 20% and most desirably about 3 to 16%. By adjusting the amount of erosion rate modifier, the life of the drop-in block can be varied from 1 to about 5 months.

The processing aid is a polyoxypropylenepolyoxyethylene block copolymer which has a molecular weight from about 2,000 to about 16,000 preferably about 4,000 to 14,000. Such block copolymers are commercially available, for instance under the trademark Pluronic, and have a melting point from about 45° to 60° C., which permits the block to be made by extrusion. The processing aid is present in concentrations from about 0.5 to 30% by weight of the total composition, preferably about 1 to 25% and most preferably about 2 to 20%.

The addition of an internal lubricant to the composition is necessary to achieve a smooth surface texture. The preferred internal lubricant is isobornyl acetate or silicon oil or a mixture thereof, and is present from about 0.05 to 8% by weight of the block, preferably about 0.1 to 7% and most desirably about 1 to 6%. A preferred silicon oil is polydimethyl siloxane having a viscosity from about 20 to 12,500 centiposes. Both the isobornyl acetate and silicon oil have the capacity to function as a defoamer to minimize foam generated at the air-water interface immediately after flushing, which has the advantageous result that air and residual chlorine is not entrapped at the airwater-porcelain interface where stain formation takes place.

Theoretically any water soluble acidic chelating agent can be used in this invention. Most of these are organic in nature. However in recent years, considerable controversy has centered upon the contribution of phosphate built detergents to excessive algae growth and subsequent eutrophication of natural receiving waters and many jurisdictions have legislatively prohibited the use phosphorous in detergents, household and commercial cleaning products, and the like. Accordingly the powerful inorganic acidic chelating agents such as hexametaphosphoric acid and the like, and organic acidic agents such as phosphonic acids and the like are not used because of the possibility of creating environmental problems.

In the invention, the chelating agent is fumaric acid, L-aspartic acid or citric acid, or a mixture of two or more of these acids. They are biodegradable and are currently being used safely as food additives. It has been discovered that these chelating agents are chemically compatible with the surface erodible controlled releasing matrix during the extrusion process to form the block and when subsequently immersed, in the extruded block form, in water closets for a prolonged period of time. The acidic chelating agent is used in an amount so that the pH of a 10 ppm solution of the block will be about 4.0 to 7, preferably about 4.3 to 6.7 and is therefore generally about 10 to 60%, more usually about 15 to 55%, and most preferably about 20 to 50% of the block.

The cleansing block of the present invention usually also contains a neutral pH salt as a density modifier. Most preferable is anhydrous sodium sulfate having a density of about 1.45 to 1.65 g/ml. The incorporation of the density modifier into the composition increases the density of the extruded block into the desired range and sufficiently to prevent the block from moving during flushing inside the water closet. As a result, the rate of erosion of the block and the rate of release of the active ingredients from the block is altered. Usually the anhydrous sodium sulfate is present in an amount of about 3 to 35%, preferably about 5 to 30%, and most usually about 10 to 25% by weight of the total composition.

The block of this invention also preferably contains a color indicator. The dyes used must be water soluble and acid stable when present in an acidic environment for a prolonged period of time and must also remain stable during the extrusion process of preparing the block. It is usually employed in an amount of about 1 to 25%, generally about 3 to 20%, and most usually about 5 to 15% based on the weight of the block. Suitable dyes include FD&C Blue No. 1 (Brilliant Blue FCF, CI No. 42090), FD&C Green No. 3 (Fast Green, CI No. 42053), FD&C Yellow No. 5 (Tartrazine, CI NO. 19140), FD&C Yellow No. 6 (Sunset Yellow FCF, CI No. 15985) and mixtures thereof.

Other ingredients may be incorporated into the cleansing block of this invention as long as they do not adversely affect the properties of the block. Examples include, but are not limited to, perfumes, germicides, preservatives, surfactants and fillers.

The blocks of the present invention are conveniently and preferably made by extrusion. Usually all of the solid ingredients are mixed in any suitable blending equipment followed by the addition o liquid ingredients under blending conditions. The resulting homogeneous blend is then extruded.

In order to further illustrate the present invention, various examples are described below. In these examples, as well as throughout the balance of this specification and claims, all parts and percentages are by weight and all temperatures in degrees centigrade unless otherwise indicated.

In the examples which follow, all powder ingredients were first mixed in a ribbon blender followed by addition of the liquid ingredients slowly and stepwise to ensure uniformity of the blend. The resulting homogeneous blends were extruded using a single screw Bonnot extruder equipped with a water jacket to allow control of the temperature of the extrusion barrel and die. In general, the temperature of the barrel was about 40° to 45° C. and the temperature of the die was about 10° higher than the barrel.

EXAMPLES 1–4

Cleansing blocks having a weight of either 50 or 100 grams were fabricated by extruding a uniform mixture of the following ingredients:

| Ingredient | % (Weight/Weight) | | | |
|---|---|---|---|---|
| | 1 | 2 | 3 | 4 |
| Hydroxypropylcellulose | 18.0 | 18.0 | 18.0 | 18.0 |
| Polyethoxylated (5) cetyl alcohol | 10.0 | 10.0 | | |
| Polyethoxylated (5) stearyl alcohol | | | 8.0 | 8.0 |
| Pluronic F127 | 9.0 | 9.0 | 9.0 | 9.0 |
| Furmaric acid | 30.0 | 15.0 | 17.0 | |
| Citric acid | | 15.0 | | |
| L-aspartic acid | | | 15.0 | 32.0 |
| Isobornyl acetate | 1.5 | 1.5 | 1.5 | 1.5 |
| FD&C Blue No. 1 | 12.0 | 12.0 | 12.0 | 12.0 |
| Sodium sulfate, anhydrous | 18.5 | 18.5 | 18.2 | 18.2 |
| Germall II (preservative) | 0.5 | 0.5 | 0.5 | 0.5 |
| Pine oil | 0.5 | 0.5 | 0.5 | 0.5 |
| Polydimethylsiloxane | | | 0.3 | 0.3 |

The density of the resulting extruded blocks was in the range of 1.42 to 1.50 g/ml. The longevity of the blocks in the water closet was determined using a computer controlled toilet which was flushed according to a simulated home use condition. The toilet was flushed 15 times a day at intervals of 80 minutes between 6 A.M. and 10 P.M. and at intervals of 160 minutes between 10 P.M. and 6 A.M. For the duration of the test the water temperature was maintained about 16° C. The end point was defined as the 7th day prior to the completion of the dissolution of the entire block. The results achieved are shown in the following Table.

| EXAMPLE | 1 | | 2 | | 3 | | 4 | |
|---|---|---|---|---|---|---|---|---|
| Weight of block (g) | 50 | 100 | 50 | 100 | 50 | 100 | 50 | 100 |
| Number of flushes | 1520 | 2300 | 1485 | 2250 | 1380 | 2100 | 1432 | 2000 |

For the entire effective lifespan of the blocks in the water closets shown in the foregoing Table, the concentration of the color indicator in the water was in the range of 0.15 to 0.45 ppm thereby providing the toilet water with a telltale blue hue.

EXAMPLES 5–6

Cleansing blocks having a weight of either 50 or 100 grams were made by extruding a uniform mixture of the following ingredients:

| Ingredient | % (Weight/Weight) | |
|---|---|---|
| | 5 | 6 |
| Polyethylene oxide | 20.0 | 20.0 |

-continued

| Ingredient | % (Weight/Weight) | |
|---|---|---|
| | 5 | 6 |
| Polyethoxylated (4) cetyl alcohol | 7.0 | 6.0 |
| Polyethoxylated (6) stearyl alcohol | 10.0 | 10.0 |
| Pluronic F108 | 7.0 | 7.0 |
| Furmaric acid | 20.0 | |
| Citric acid | | 25.0 |
| L-aspartic acid | 10.0 | |
| FD&C Blue No. 1 | 10.0 | 7.0 |
| FD&C Yellow No. 5 | | 3.5 |
| Isobornyl acetate | 1.0 | 1.5 |
| Sodium sulfate, anhydrous | 18.7 | 14.0 |
| Germall II (preservative) | 0.5 | 0.5 |
| Pine oil | 0.5 | 0.5 |
| Polydimethylsiloxane | 0.3 | |

The block of Example 5 had a density of about 1.4 g/cc and the block of Example 6 was about 1.32 g/cc. The longevity of the blocks was determined by the procedure in the proceeding examples to produce the following results:

| EXAMPLE | 5 | | 6 | |
|---|---|---|---|---|
| Weight of block (g) | 50 | 100 | 50 | 100 |
| Number of flushes | 940 | 1420 | 1080 | 1650 |

The concentration of the color indicator was about 0.2 to about 0.5 ppm during the effective lifespan of the blocks in the water closet thereby providing the water in the toilet with a distinctive color.

EXAMPLES 7–8

Cleansing blocks having a weight of 100 grams were made by extruding a uniform mixture of the following ingredients:

| Ingredient | % Weight/Weight | |
|---|---|---|
| | 7 | 8 |
| Hydroxypropylcellulose | 9.5 | 14.0 |
| Polyethoxylated (5) stearyl alcohol | 10.0 | 9.0 |
| Pluronic F127 | 10.0 | 7.0 |
| Fumaric acid | 31.8 | 25.0 |
| Citric acid | | 3.0 |
| L-aspartic acid | 6.0 | 12.0 |
| Isobornyl acetate | 4.5 | 3.5 |
| Polydimethylsiloxane | 0.7 | 0.5 |
| Sodium sulfate, anhydrous | 15.0 | 13.5 |
| FD&C Blue No. 1 | 11.0 | 12.0 |
| Germall II (preservative) | 0.5 | 0.5 |
| Pine oil | 1.0 | |

The block of Example 7 had a density of about 1.35 g/cc and the block of Example 8 was about 1.28 g/cc. The longevity of the blocks was determined as in the proceeding examples as follows:

| EXAMPLE | 7 | 8 |
|---|---|---|
| Weight of block (g) | 100 | 100 |
| Number of flushes | 1550 | 2350 |

The concentration of the color indicator was about 0.1 to about 0.6 ppm during the effective lifespan of the blocks in the water closet.

EXAMPLES 9–17

Additional blocks were prepared with the following ingredients:

| EXAMPLE | 9 | 10 | 11 | 12 | 13 | 14 | 15 | 16 | 17 |
|---|---|---|---|---|---|---|---|---|---|
| Polyoxylated (5) stearyl alcohol | 10.0 | 11.0 | 9.0 | 9.0 | 7.5 | 8.5 | 8.5 | 9.0 | 10.0 |
| Hydroxypropylcellulose | 11.0 | 12.0 | 14.0 | 14.0 | 11.5 | 10.0 | 10.0 | 9.5 | 9.5 |
| Pluronic F-127 | 8.0 | 1.0 | 6.0 | 7.0 | 9.5 | 9.5 | 9.5 | 10.5 | 10.0 |
| Fumaric acid | 30.5 | 30.0 | 37.0 | 25.0 | 27.3 | 34.5 | 34.5 | 33.5 | 31.8 |
| L-aspartic acid | 6.0 | — | — | 12.0 | 12.0 | 6.0 | 6.0 | 6.0 | 6.0 |
| Sodium sulfate | 19.0 | 20.5 | 18.2 | 16.5 | 15.0 | 15.0 | 15.5 | 13.5 | 16.0 |
| Isobornyl acetate | 4.0 | 4.5 | 3.0 | 3.5 | 4.0 | 4.5 | 4.0 | 4.5 | 3.5 |
| Polydimethylsiloxane | 0.5 | 0.5 | 0.3 | 0.5 | 0.7 | 0.5 | 0.5 | 0.5 | 0.7 |
| Acid Blue #9 | 10.5 | 10.0 | 12.0 | 12.0 | 12.0 | 11.0 | 11.0 | 11.0 | 11.0 |
| Germall II | 0.5 | 0.5 | 0.5 | 0.5 | 0.5 | 0.5 | 0.5 | 0.5 | 0.5 |
| Citric acid | — | 10.0 | — | — | — | — | — | — | — |
| Fragrance | — | — | — | — | — | — | 0.5 | — | — |
| Pine Oil | — | — | — | — | — | — | — | — | 1.0 |

Various changes and modifications can be made in the product and process of this invention without departing from the spirit and scope thereof. The various embodiments which have been set forth herein were for the purpose of further illustrating the invention but were not intended to limit it.

What is claimed is:

1. A surface erodible, controlled releasing, free standing cleansing block for domestic water closets which releases its active ingredients uniformly and continuously to the water to inhibit the formation of mineral stains on porcelain and to continuously provide a mild acidic environment to thereby give the water a sparkling appearance for an extended period of time of about 1 to 5 months which comprises about 2 to 35% of controlled releasing agent selected from the group consisting of hydroxypropyl cellulose having a molecular weight of about 500,000 to 1,500,000, polyethyleneoxide having a molecular weight from about 2 million to 6 million and mixtures thereof, about 1 to 25% by weight of erosion rate modifier selected from the group consisting of polyalkoxylated cetyl alcohol, polyalkoxylated stearyl alcohol and mixtures thereof, containing about 2 to 8 alkyleneoxy units per molecule and a molecular weight of about 360 to 650, about 0.5 to 30% of processing aid which is a polyoxypropylene-polyoxyethylene block copolymer having a molecular weight of about 2,000 to 16,000, about 10 to 60% of a chelating and pH control agent selected from the group consisting of fumaric acid, L-aspartic acid, citric acid and mixtures thereof, about 0.05 to 8% of an internal lubricant selected from the group consisting of isobornyl acetate, silicon oil and mixtures thereof, and optionally up to about 35% of a neutral pH salt as density modifier, said block having a density of about 1.2 to 1.8 g/ml and an aqueous solution of 10 ppm of said block having a pH between about 4.0 and 7.

2. The surface erodible, controlled releasing, free standing cleansing block of claim 1 containing about 1 to 25% of water soluble, acid stable dye.

3. The surface erodible, controlled releasing, free standing block of claim 2 in which the amount of controlled releasing agent is about 4 to 25%, the amount of erosion rate modifier is about 2 to 20%, the amount of block copolymer is about 1 to 25%, the amount of internal lubricant is about 0.1 to 7%, the amount of chelating and pH control agent is about 15 to 55% and the amount of dye is about 3 to 20% by weight.

4. The surface erodible, controlled releasing, free standing cleansing block of claim 3 further comprising about 5%–30% anhydrous sodium sulfate as a density modifier.

5. The surface erodible, controlled releasing, free standing cleansing block of claim 4 in which the amount of controlled releasing agent is about 5 to 22%, the amount of erosion rate modifier is about 3 to 16%, the amount of block copolymer is about 2 to 20%, the amount of chelating and pH controlling agent is about 20 to 50%, the amount of internal lubricant is about 1 to 6%, the amount of sodium sulfate is about 10 to 25% and the amount of dye is about 5 to 15%.

6. The surface erodible, controlled releasing, free standing cleansing block of claim 5 in which the chelating and pH control agent comprises fumaric acid.

7. The surface erodible, controlled releasing, free standing cleansing block of claim 5 in which the chelating and pH control agent is a mixture of fumaric acid and citric acid.

8. The surface erodible, controlled releasing, free standing cleansing block of claim 1 in which the chelating and pH control agent comprises L-aspartic acid.

9. The surface erodible, controlled releasing, free standing cleansing block of claim 1 having a weight of about 40 to 125 grams.

10. The surface erodible, controlled releasing, free standing cleansing block of claim 1 further comprising about 5–30% of a neutral pH salt as a density modifier.

11. A surface erodible, controlled releasing, free standing cleansing block for domestic water closets which releases its active ingredients uniformly and continuously to the water to inhibit the formation of mineral stains on porcelain and to continuously provide a mild acidic environment to thereby give the water a sparkling appearance for an extended period of time of about 1 to 5 months which consists essentially of about 2 and 35% of controlled releasing agent selected from the group consisting of hydroxypropyl cellulose having a molecular weight of about 500,000 to 1,500,000, polyethyleneoxide having a molecular weight from about 2 million to 6 million and mixtures thereof, about 1 and 25% by weight of erosion rate modifier selected from the group consisting of polyalkoxylated cetyl alcohol, polyalkoxylated stearyl alcohol and mixtures thereof, containing about 2 to 8 alkyleneoxy units per molecule and a molecular weight of about 360 to 650, about 0.5 to 30% of processing aid which is a polyoxypropylene-polyoxyethylene block copolymer having a molecular weight of about 2,000 to 16,000, about 10 to 60% of a chelating and pH control agent selected from the group consisting of fumaric acid, L-aspartic acid, citric acid and mixtures thereof, about 0.05 to 8% of an internal lubricant selected from the group consisting of isobornyl acetate, silicon oil and mixtures thereof, and about 3 to 35% of a neutral pH salt as a density modifier so as to provide said block with a density of about 1.2 to 1.8 g/ml, an aqueous solution of 10 ppm of said block having a pH between about 4 and 7.

12. The surface erodible, controlled releasing, free standing block of claim 11 in which the amount of controlled releasing agent is about 4 to 25%, the amount of erosion rate modifier is about 2 to 20%, the amount of block copolymer is about 1 to 25%, the amount of internal lubricant is about 0.1 to 7%, the amount of chelating and pH control agent is about 15 to 55%, the amount of density modifier is about 5 to 30% and the amount of dye is about 3 to 20% by weight.

13. A method of inhibiting the formation of mineral deposits on a porcelain lavatory and imparting a sparkling appearance to the water therein which comprises immersing in the cistern of the lavatory the freestanding block of claim 1 whereby a pH of between about 4 and 7 is imparted to the water of the lavatory for an extended period of time of about 1 to 5 months.

14. A method of inhibiting the formation of mineral deposits on a porcelain lavatory and imparting a sparkling appearance to the water therein which comprises immersing in the cistern of the lavatory the freestanding block of claim 2 whereby a pH of between about 4 and 7 is imparted to the water of the lavatory for an extended period of time of about 1 to 5 months.

15. A method of inhibiting the formation of mineral deposits on a porcelain lavatory and imparting a sparkling appearance to the water therein which comprises immersing in the cistern of the lavatory the freestanding block of claim 3 whereby a pH of between about 4 and 7 is imparted to the water of the lavatory for an extended period of time of about 1 to 5 months.

16. A method of inhibiting the formation of mineral deposits on a porcelain lavatory and imparting a sparkling appearance to the water therein which comprises immersing in the cistern of the lavatory the freestanding block of claim 5 whereby a pH of between about 4 and 7 is imparted to the water of the lavatory for an extended period of time of about 1 to 5 months.

17. A method of inhibiting the formation of mineral deposits on a porcelain lavatory and imparting a sparkling appearance to the water therein which comprises immersing in the cistern of the lavatory the freestanding block of claim 9 whereby a pH of between about 4 and 7 is imparted to the water of the lavatory for an extended period of time of about 1 to 5 months.

* * * * *